United States Patent [19]

Hofmann

[11] Patent Number: 4,804,190

[45] Date of Patent: Feb. 14, 1989

[54] OUTER SPACE TRAVELLING BOARD GAME

[76] Inventor: Elsa O. Hofmann, P.O. Box 456, Montclair, N.J. 07042

[21] Appl. No.: 61,828

[22] Filed: Jun. 15, 1987

[51] Int. Cl.[4] ..... A63F 3/00

[52] U.S. Cl. ..... 273/250

[58] Field of Search ..... 273/250, 251, 252, 249, 273/253

[56] References Cited

U.S. PATENT DOCUMENTS

| | | | |
|---|---|---|---|
| 1,538,134 | 5/1925 | Muir | 273/253 |
| 3,097,451 | 7/1963 | Newhouse | 273/253 |
| 3,223,420 | 12/1965 | Turner | 273/253 |
| 4,035,932 | 7/1977 | Massey | 273/249 |

*Primary Examiner*—Richard C. Pinkham
*Assistant Examiner*—Benjamin Layno
*Attorney, Agent, or Firm*—Richard H. Laughlin; William Pegg, Jr.

[57] ABSTRACT

An entertaining board game for pre-school-age children and children in the primary grades. The board game comprises a path of globe shaped spaces having a starting point and an ending point. Each globe shaped space is distinguished by a color or a picture depicted thereon. Corresponding to the globe shaped spaces are playing cards each either having a colored globe, a picture, or a colored globe and picture thereon. Players move by selecting by chance a card, matching the color of the globe or picture on the card with a corresponding globe shaped space and moving to the appropriate globe shaped space according to the rules. Thus, the game is designed to introduce outer space through color matching and picture matching. Rhymes and mythology as stated on certain cards is also introduced giving the child a unique experience or adventure on the pictured places as pictured on the playing cards, but it is not necessary to read in order to play the game.

1 Claim, 5 Drawing Sheets

| FIG. 1A | FIG. 1B |
|---|---|

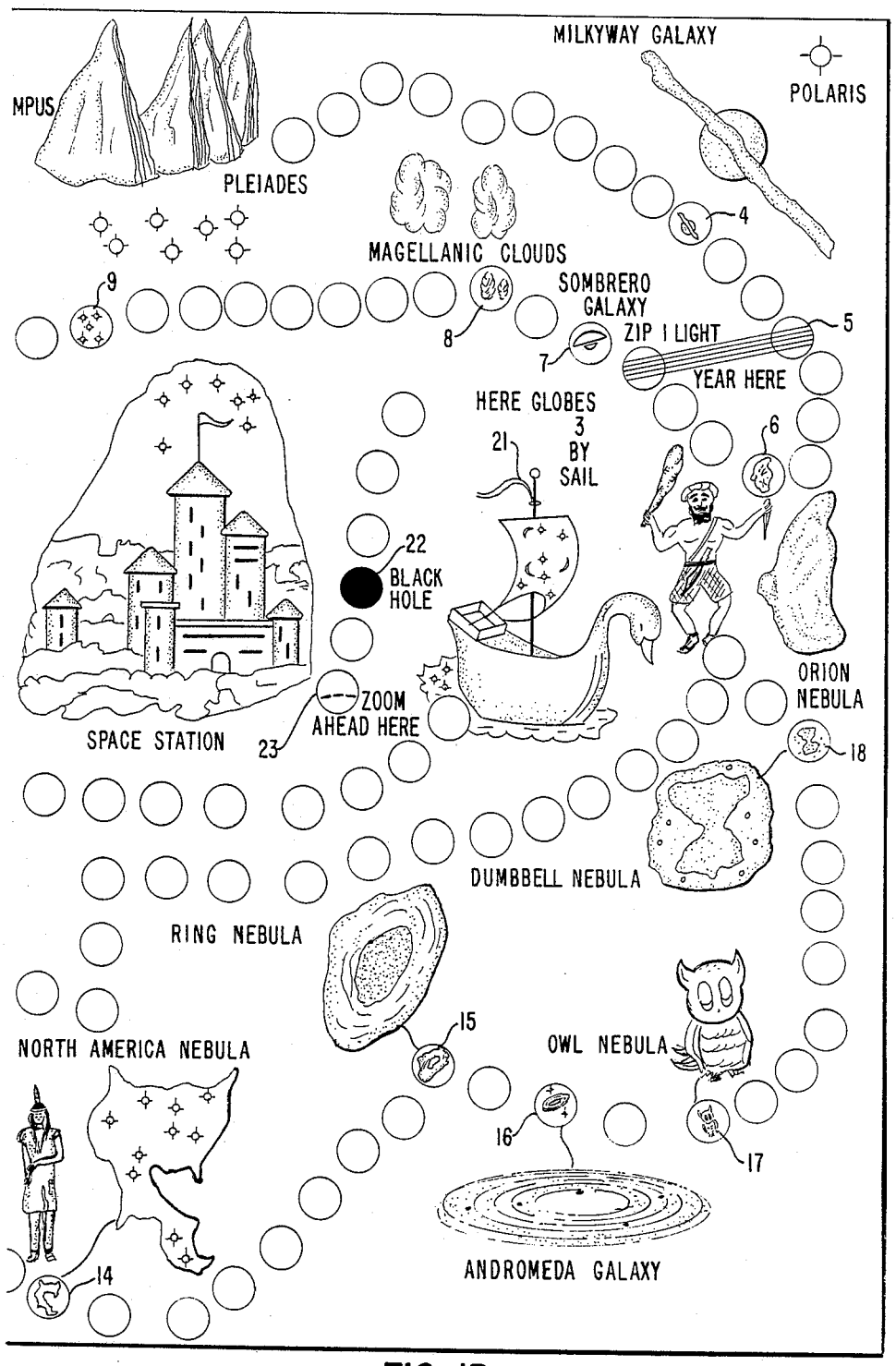
FIG. IB

OUTER SPACE TRAVELLING BOARD GAME

BACKGROUND OF THE INVENTION

Children develop confidence through learning to control and understand the worlds in which they live. Ideally, this experience is given to the child in a controlled and protected environment. When new information is presented with a high level of entertainment, the joy of learning is reinforced as a positive value.

SUMMARY OF THE INVENTION

The present invention is a game which gives the child the joy of new adventure in outer space.

Generally speaking, this game invention consists of a playing board having thereon a designated path along which players move by matching a selected card from the deck of playing cards to the color of the globe on the gameboard when having selected a card with a globe on it, or matching a pictured card to the picture on the gameboard. The pictured cards also give the child a unique experience or adventure in a pictured place never before having visited. This beginning level game opens the mind of the child to the future of space exploration.

There are several levels to this invention. Not only does a child learn to color match, but they also learn to pay careful attention to detail in any picture, place or thing they may see. This invention also introduces the child to mythology on those designated celestial objects which from ancient times have had mythological stories involved with them. When mythology does not apply to a pictured place, the child is given an adventure of some kind to enjoy which is stated and pictured on the playing card and pictured on the gameboard. Sometimes it is just to find a certain personage at the depicted place.

The rules of the game are such that a player moves backwards or forwards depending whether the pictured place is backward or forward, but whether the player moves backward or forward, they receive a star for their scorecard. If it is a colored globe that is selected, the player moves forward except in the case when the Black Hole card is selected. In that case, the player misses a turn for having been trapped in the Black Hole.

The object of the game as stated in the rules is to be first player to land on the Space Station with 6 stars on the scorecard. A player collects a star each time they land on a pictured place. The rules also state if a player lands on the Space Station with less than 6 stars on their scorecard, they must return to the Dumbbell Nebula and try again for 6 stars.

The game of the present invention has a plan view of the gameboard not only different in appearance from Muir's, but it is put on a level a younger child can play and presents the child with unique celestial objects not found on Muir's game invention.

In Newhouse's game invention, a player is confined to the solar system. A player does not visit 5 different galaxies, 8 different nebulae, an asteroid, or circle the Enke Doodle ring of Saturn, or climb Mount Olympus, visit three different star systems, travel with the speed of light past 5 globes, get stuck in a Black Hole, as depicted on the gameboard and on the playing cards. Nor does a player sail by three globes in a sailing ship as depicted on the gameboard or asked to find certain personages described on the playing card and depicted on the gameboard, nor does Newhouse's game give a player the same kind of adventures or introduce the child to mythology and rhyming using outer space.

In Turner's game invention, the buying and selling of space cargo within the solar system is the object of the game. This makes my game invention clearly different from Turner's which is not based on economy nor confined to the solar system, but based on having adventures throughout the Universe using color matching and picture matching to move along the path and introducing mythology and rhyming along with the unique experience.

DETAILED DESCRIPTION OF THE PRESENT INVENTION

FIG. 1A and FIG. 1B illustrates the playing board according to a preferred embodiment of the present invention. A designated path of travel is provided on the playing surface around which players travel from Earth to the Space Station. In accordance with the instruction in the rules, a player selects a playing card from the top of the deck and travels to the colored globe or globes or pictured place whether it be forward or backward. There are 23 pictured places to visit after leaving planet Earth and on each pictured place, a player is provided with a unique experience embodied by the unique environment. This game, therefore, also provides the beginning level of science of outer space to be opened and explored intellectually with questions such as: What would it be like to bowl on the Magellanic Clouds? What would it be like to circle the Enke Doodle Ring of Saturn? What would it be like to sailing in outer space? Or visit Andromeda Galaxy? Are there aliens on the Whirlpool Galaxy? What would the universe look like if a spaceship travelled with the speed of light? Is is possible for spaceships to travel faster than the speed of light? If so, how?

On FIG. 1A and FIG. 1B the plan view of the gameboard, numbers 1 to 23 are the pictured places that may be visited after leaving the Earth. The pictures represent leaving the Earth. The pictures represent the following galaxies: 2 Whirlpool Galaxy, 4 Milkyway Galaxy, 7 Sombrero Galaxy, 8 Magellanic Clouds and 16 Andromeda Galaxy. On each pictured galaxy, the player has a unique adventure as described in the rules and on the playing cards with pictures.

The following pictured nebulae are visited and on each a player has a unique experience or adventure. These nebulae are: 1 Rosette Nebula, 12 Crab Nebula, 13 Veil Nebula, 17 Owl Nebula, 18 Dumbbell Nebula and 20 Horsehead Nebula. Two planets are visited: 3 Mars and 11 Saturn and one asteroid, 19.

An alternate style of this game may be played by using die or a spinner.

FIG. 2 shows a picture of one colored globe in red or pink, two of the six colors used along the designated path on the playing board. If a player selects a globe, they move to the nearest globe along the path of that color.

Figures 1, 1A:
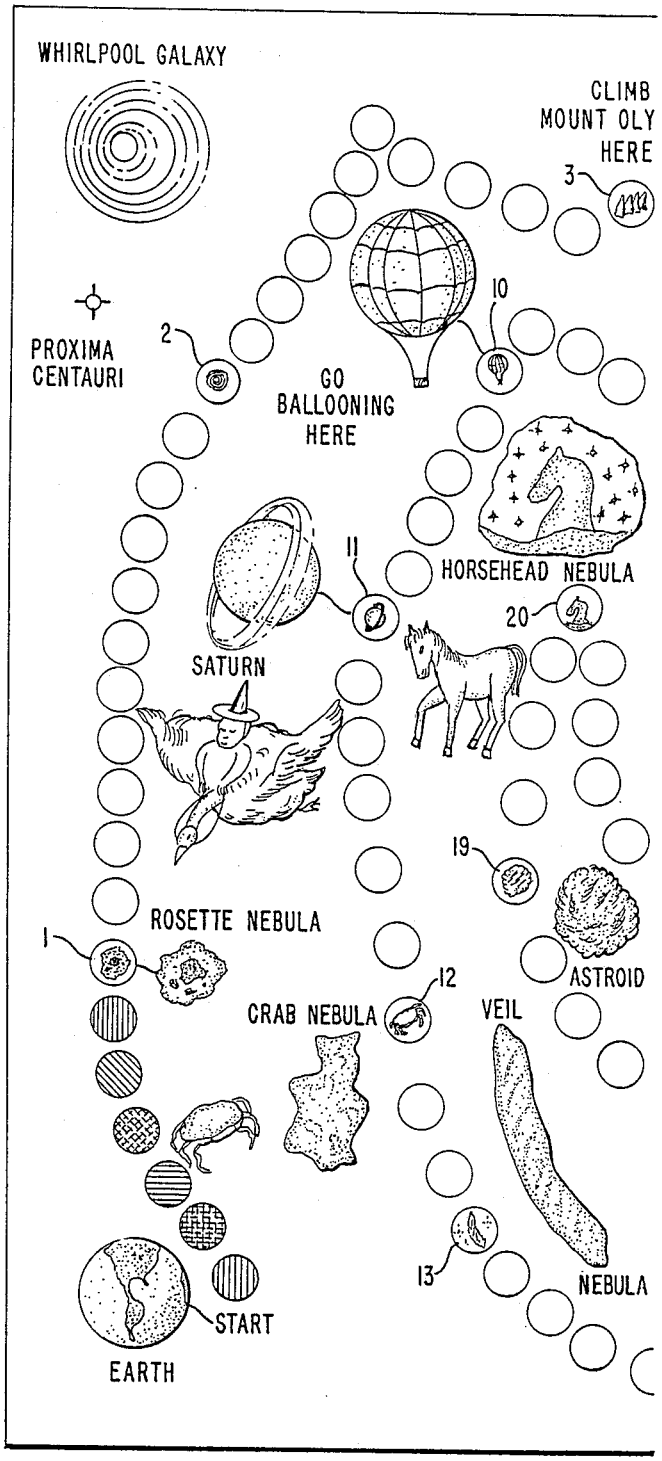
Figure 2:
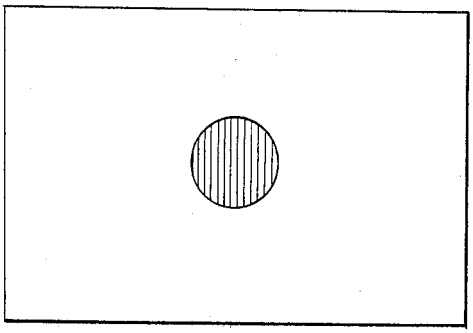
FIG. 2 to FIG. 23 show and describe the playing cards.
Figure 3:
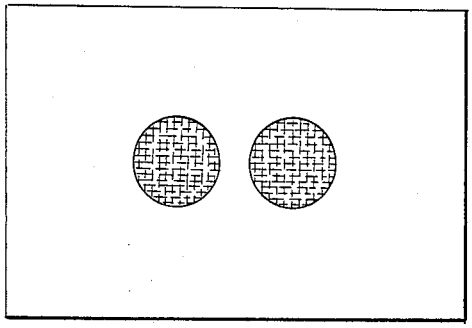

FIG. 3 shows a picture of the globes in yellow, another of the colors along the designated path of colored globes and pictured places. If selecting a playing card with two globes on it, a player may move to the two nearest globes of that color. The other colors of globes are: blue, orange, green and red.

As stated in the rules, players move around the gameboard in turn. The first player is the one who selects the colored globe that is nearest to or the same as the colored globe that is first in the designated path. As pink is first, the player selecting pink or a globe of a color nearest to pink, would go first. The player who selects a colored globe closest to the one who is first goes second, etc. If two players select the same color, they must draw again until each player has chosen a different colored globe.

Figure 4:
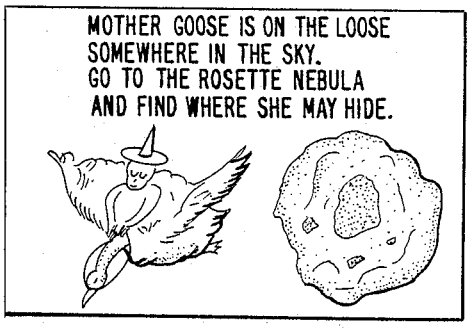

FIG. 4 tells a nursery rhyme about Mother Goose and tells the player to look for her on the Rosette Nebula.

Figure 5:
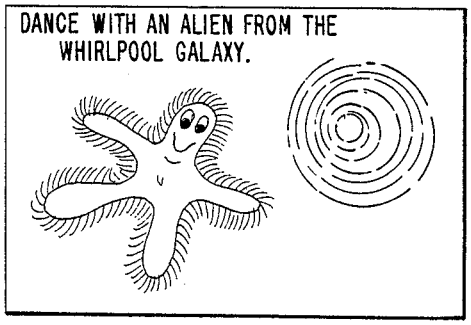

FIG. 5 takes a player to the Whirlpool Galaxy where they dance with an alien.

Figure 6:
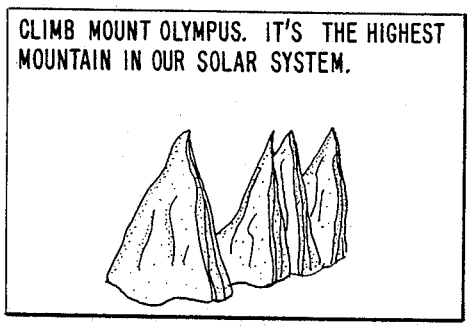

FIG. 6 tells the child to climb Mount Olympus, the highest mountain in our solar system.

Figure 7:
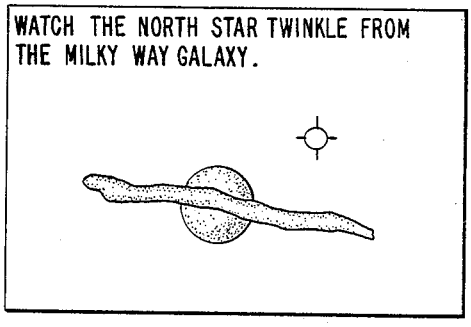

FIG. 7 tells the player to watch the North star twinkle from the Milkyway Galaxy.

Figure 8:
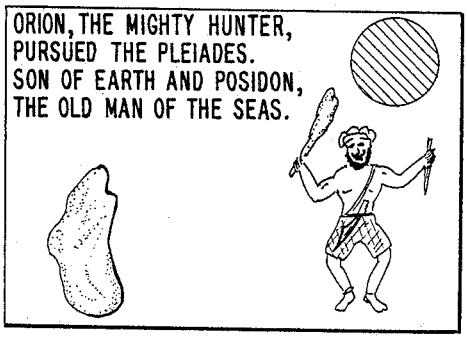

FIG. 8 introduces mythology by telling the player the ancestry of Orion. On this pictured place, a player must remain until they draw a globe the color of the globe in the right-hand corner of the playing card.

Figure 9:
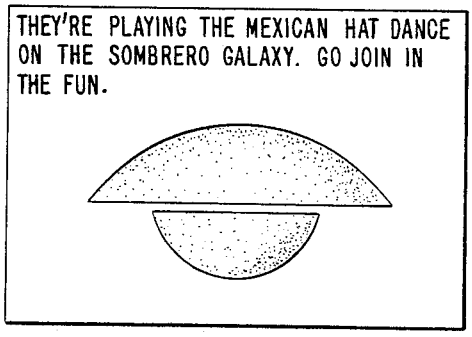

FIG. 9 takes a player to the Sombrero Galaxy where the Mexican Hat Dance is playing and they are invited to join the fun.

Figure 10:
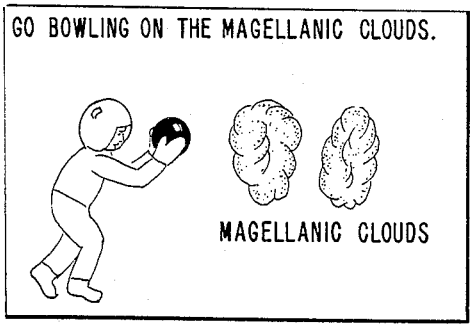

FIG. 10 brings the player to the Magellanic Clouds where they go bowling.

Figure 11:
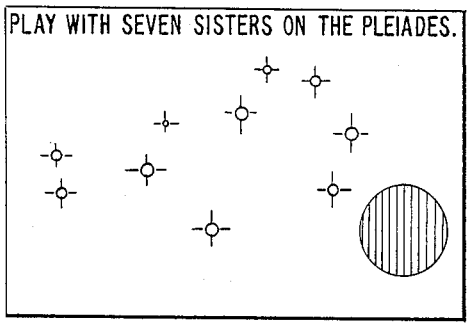

FIG. 11 introduces mythology by telling the player to play with seven sisters on the Pleiades. A player must remain at this pictured place until they select a colored globe the same as the one in the right-hand of the playing card as is stated in the rules.

Figure 12:
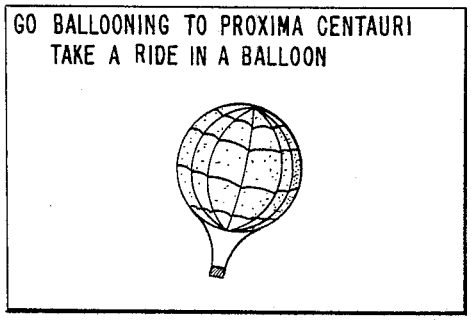

FIG. 12 tells the player to take a ride in a balloon to Proxima Centauri, the second closest star to Earth.

Figure 13:
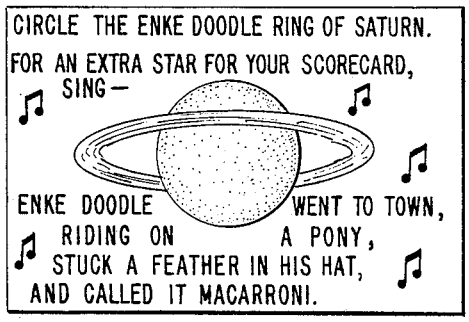

FIG. 13 tells the player to circle the Enke Doodle Ring of Saturn. For an extra star for their scorecard, they must sing Enke Doodle went to town riding on a pony, stuck a feather in his hat and called it macaroni.

Figure 14:
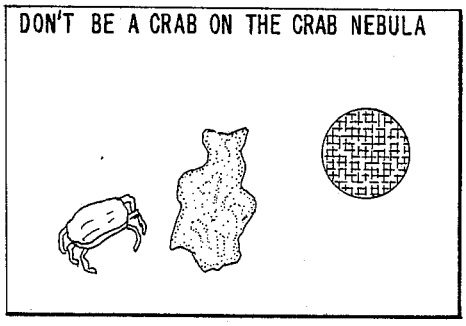

FIG. 14 takes a player to the Crab Nebula where they must stay until a card the color of the globe in the right hand corner of this playing card is selected from the deck as stated in the rules.

Figure 15:
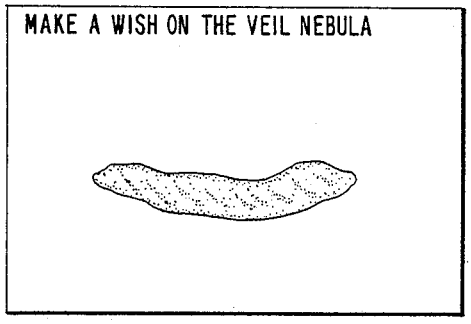

FIG. 15 shows a pictured card of the Veil Nebula where the player is asked to make a wish. This is founded on Salome being granted a wish after she danced the Dance of the Seven Veils.

Figure 16:
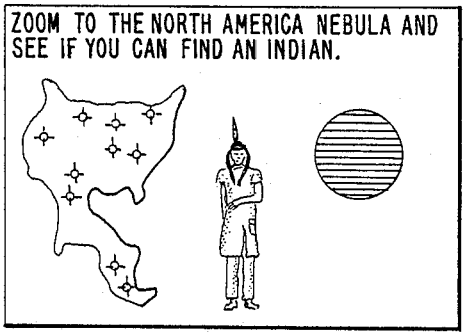

FIG. 16 shows the North America Nebula with an Indian beside it. The player is told to go to North America and find an Indian. The player must stay at this pictured place until they draw a colored globe card the same color as the globe in the right hand corner of this playing card.

Figure 17:
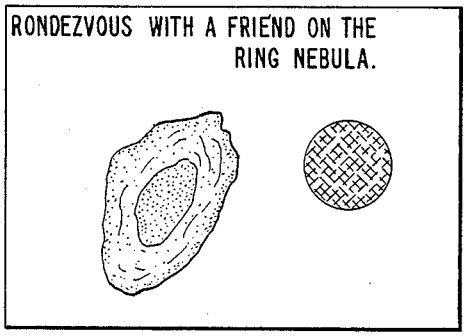

FIG. 17 shows a playing card that tells a player to have a rendezvous with a friend on the Ring Nebula. As stated in the rules, the player must stay there until a card is drawn with the same color of a globe as shown on this pictured card.

Figure 18:
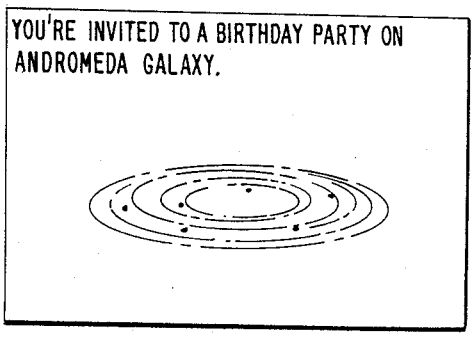

FIG. 18 shows a playing card that invites a player to a birthday party on the Andromeda Galaxy.

Figure 19:
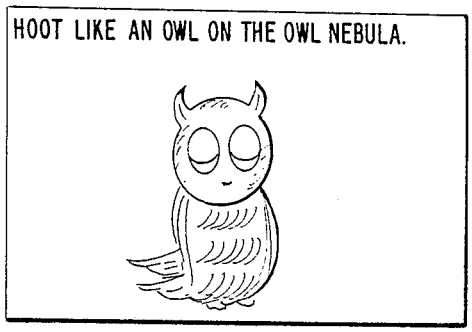

FIG. 19 shows a playing card that takes a player to the Owl Nebula and asks the player to hoot like an Owl.

Figure 20:
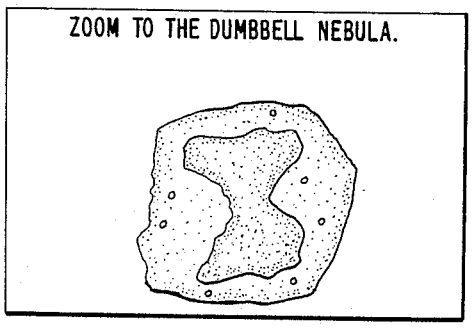

FIG. 20 shows the Dumbbell Nebula where a player is told to zoom.

Figure 21:
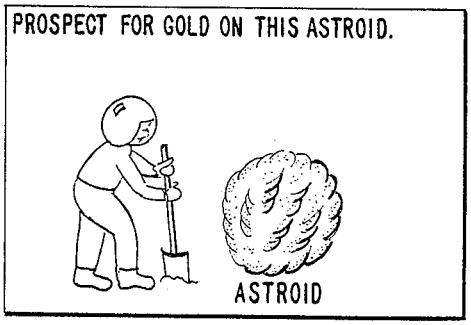

FIG. 21 shows a picture of an astronaut digging for gold and the player is invited to prospect for gold.

Figure 22:
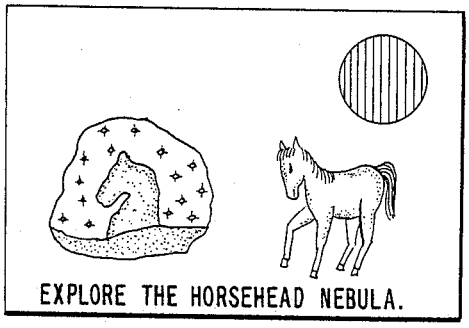

FIG. 22 shows a picture of Horsehead Nebula and invites the player to explore the Horsehead Nebula. As stated in the rules, a player must stay on this pictured place until they draw a globe the same color as the globe on the right hand side of this pictured card.

Figure 23:
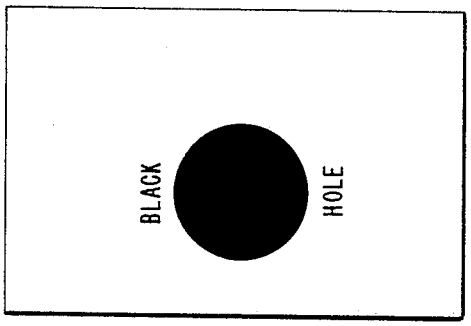

FIG. 23 shows a picture of the Black Hole. As stated in the rules, a player must miss one turn if they draw this playing card as the Black Hole is a trap.

Figure 24:
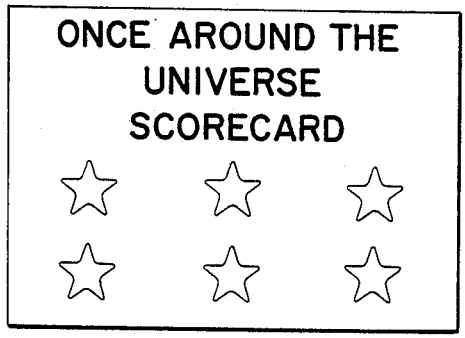

FIG. 24 shows a scorecard with 6 stars on it. As stated in the rules, a player must collect 6 stars for their scorecard and be the first to arrive on the Space Station inorder to win the game. If a player arrives on the Space Station with less than 6 stars on their scorecard, they must return to the Dumbbell Nebula and try again for 6 stars.

As revealed in the above disclosure, this game not only affords a player great fun through color and picture matching and unique experiences in unique celestial places, it also gives a child their first introduction to outer space using mythology and nursery rhymes. This game also rewards a child for following directions and teaches the child to pay careful attention to details in things that he or she sees.

I claim:

1. A board game comprising: a playing board having a playing path thereon, said path having a plurality of globe shaped spaces, said globe shaped spaces comprising a first group of globe shaped spaces each being distinguished by one of a plurality of different colors, and a second group of globe shaped spaces each being distinguished by one of a plurality of pictures, a colored globe corresponding to said first group of globe shaped spaces and a picture corresponding to said second group of globe shaped spaces, a plurality of playing pieces, movement of said playing pieces along said path being determined by said playing cards which are drawn by chance, a plurality of scorecards used for keeping track of the number of pictured globe shaped spaces a playing piece has landed on.

* * * * *